US007641606B2

(12) United States Patent
Watanabe

(10) Patent No.: US 7,641,606 B2
(45) Date of Patent: Jan. 5, 2010

(54) SHEET CONVEYANCE ROLLER AND SHEET PROCESSING APPARATUS WITH RFID UNIT EMBEDDED IN THE ROTATIONAL MEMBER

(75) Inventor: Kiyoshi Watanabe, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/443,378

(22) Filed: May 31, 2006

(65) Prior Publication Data

US 2006/0284060 A1 Dec. 21, 2006

(30) Foreign Application Priority Data

Jun. 1, 2005 (JP) ..... 2005-161140

(51) Int. Cl.
*B05C 1/08* (2006.01)
*B25F 5/02* (2006.01)

(52) U.S. Cl. ..... 492/10; 399/12; 399/24; 700/215; 340/572.1; 492/9

(58) Field of Classification Search ..... 250/231.1; 340/572.1, 10.1, 10.52, 10.51, 10.3, 571, 340/568.1, 568.2, 5.21; 347/19, 5–7, 85, 347/86; 700/215, 217; 399/12, 13, 24; 492/9, 492/10, 48, 57

See application file for complete search history.

(56) References Cited

U.S. PATENT DOCUMENTS

| | | | | |
|---|---|---|---|---|
| 5,983,606 | A * | 11/1999 | Hannen et al. | 53/465 |
| 6,351,621 | B1 * | 2/2002 | Richards et al. | 399/111 |
| 6,520,544 | B1 * | 2/2003 | Mitchell et al. | 283/70 |
| 2004/0102870 | A1 * | 5/2004 | Andersen et al. | 700/215 |
| 2005/0101060 | A1 * | 5/2005 | Tsunoda et al. | 438/127 |
| 2006/0289620 | A1 * | 12/2006 | Yamamoto et al. | 235/375 |

FOREIGN PATENT DOCUMENTS

| | | | |
|---|---|---|---|
| JP | 2001-341290 | | 12/2001 |
| JP | 2002-6691 | | 1/2002 |
| JP | 2002293448 | A * | 10/2002 |
| JP | 2005-74829 | | 3/2005 |
| JP | 2005-107440 | | 4/2005 |

* cited by examiner

*Primary Examiner*—Thanh X Luu
*Assistant Examiner*—Francis M LeGasse, Jr.
(74) *Attorney, Agent, or Firm*—Fitzpatrick, Cella, Harper & Scinto

(57) ABSTRACT

A sheet conveyance roller, having an axis; a rotational member that is provided at the outer peripheral part of the axis capable of rotating in accordance with rotation of the axis, and conveys the sheet abutting against the outer peripheral part upon rotation; and an IC tag having a storage function and a wireless communication function. Then, at least part of the IC tag is embedded in the rotational member.

15 Claims, 12 Drawing Sheets

SHEET CONVEYANCE ROLLER AND SHEET PROCESSING APPARATUS WITH RFID UNIT EMBEDDED IN THE ROTATIONAL MEMBER

BACKGROUND OF THE INVENTION

1. Field of the Invention

The present invention relates to a sheet conveyance roller for conveying a sheet.

2. Related Background Art

In recent years, in a sheet processing apparatus such as an image forming apparatus, reuse of components has been developed in such a manner that an apparatus to be discarded is recovered and decomposed, analyzing status of use, and the available component is selected to be put into a new apparatus; or the available component is used as a maintenance component. Therefore, it has been suggested to give the information to the component by attaching an IC tag to the component and record the material information and the durability information of the component and use this information upon selection (refer to Japanese Patent Application Laid-Open (JP-A) No. 2002-006691, JP-A No. 2005-107440). In addition, it is suggested to attach the IC tag to the component and attach this component to a member in JP-A No. 2001-341290 and JP-A No. 2005-74829.

FIGS. 10 and 11 are schematic views showing a conveying member 1800 to convey a sheet. In many case, the conveyance roller 1800 has a roller part 1802 (refer to FIG. 10) that is made of a solid rubber and a foamed rubber. In the case of attaching the IC tag to the roller part 1802, it is necessary to prevent the IC tag from unfastening during rotation of a conveyance roller.

Further, if the IC tag is solidly attached, it becomes difficult to remove the IC tag that is a foreign body upon discard of the conveyance roller.

SUMMARY OF THE INVENTION

The present invention has been made taking the foregoing problems into consideration and an object of which is to prevent an IC tag from unfastening even when a conveyance roller rotates for conveying a sheet, and another object of which is to easily remove the IC tag that is a foreign object upon discard of the conveyance roller.

In order to attain the above-described object, a conveyance roller according to the present invention may comprise an axis; a rotational member that is provided at the outer peripheral part of the axis capable of rotating in accordance with rotation of the axis, and conveys the sheet abutting against the outer peripheral part upon rotation; and an IC tag having a storage function and a wireless communication function; wherein at least part of the IC tag is embedded in the area having no influence on the conveying function of the outer peripheral part of the rotational member.

In addition, the IC tag may comprise a main body of the IC tag and a sheet-like member that is attached to the main body of the IC tag; and the part of the sheet-like member is exposed from the edge face of the rotational member.

DETAILED DESCRIPTION OF THE PREFERRED EMBODIMENTS

The best mode for practicing the present invention will be described by way of illustration with reference to the drawings below. However, the sizes, the materials, the shapes of the components described in this embodiment and the relative arrangement thereof or the like have to be appropriately changed depending on the structure of the apparatus to which the invention is applied and various conditions and a scope of the invention is not limited to the following embodiments.

Figure 1:
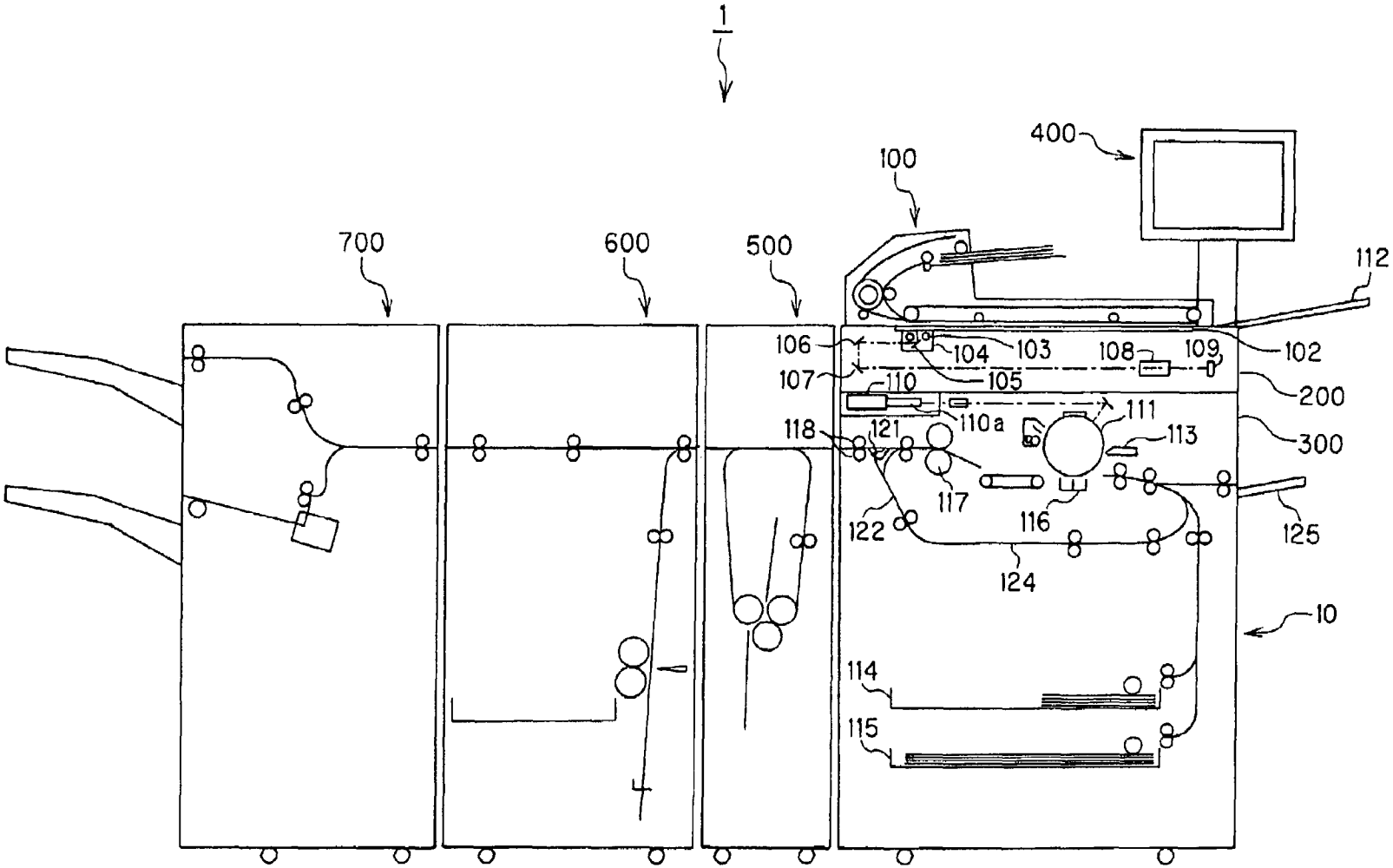
FIG. 1 is a schematic diagram showing a sheet processing apparatus according to an embodiment of the present invention.

At first, a sheet processing apparatus having a conveyance roller as a sheet conveying member, in which an IC tag having a storage function and a wireless communication function embedded therein, incorporated therein according to an embodiment of the present invention will be described below. FIG. 1 is a schematic sectional view showing the structure of a main part of an image forming apparatus 1 as a sheet processing apparatus having a sheet conveyance roller, in which an IC tag is embedded, incorporated therein according to the embodiment of the present invention.

As shown in FIG. 1, the image forming apparatus 1 is configured by a main body of an image forming apparatus 10, a folding device 500, a binding device 600, and a finisher 700; and the main body of the image forming apparatus 10 is provided with an image reader 200 for reading an original image and a printer 300. Then, on the image reader 200, a document conveying apparatus 100 is mounted.

As shown in FIG. 1, the document conveying apparatus 100 may feed the originals set upward on an original tray one by one from a head page to the left; may convey them from left to right passing through a skimming position on a platen glass 102 via a curved path; and then, may discharge them toward an external discharge tray 112. When the original passes through the skimming position on the platen glass 102 from left to right, this original image is read by a scanner portion 104, which is held at a position corresponding to the skimming position.

This reading method is generally called as an original skimming method. Specifically, when the original passes through the scanning position, a face for reading a document is irradiated by a light of a lamp 103 of a scanner portion 104, and a reflection light from the document is introduced to a lens 108 via mirrors 105, 106, and 107. The image of the light passed through the lens 108 is focused on an image pickup face of an image sensor 109.

By conveying the original so that the original passes through the skimming position from left to right in this way, the original reading scan is carried out with a direction perpendicular to the conveying direction of the original being a main scan direction and a conveying direction being a sub scan direction.

In other words, the original image is entirely read by conveying the original in the sub scan direction while reading the original image in the main scan direction every line by the image sensor 109 when the original passes through the skimming position, and the image which is optically read is converted into the image data by the image sensor 109 to be outputted. The image data outputted from the image sensor 109 is inputted to an exposure controller 110 of a printer 300 as a video signal after predetermined processing is carried out in an image signal control part 202 to be described later.

Further, by conveying the original on the platen glass 102 by the document conveying apparatus 100 to allow the original to stop at a predetermined position and scanning the scanner portion 104 from left to right in this state, it is also possible to read the original. This reading method is a so-called document fixed reading method.

In the case of reading the original without using the document conveying apparatus 100, at first, a user picks up the document conveying apparatus 100 and puts the original on the platen glass 102. Then, by scanning the scanner portion 104 from left to right, reading of the original is carried out. In other words, in the case of reading the original without using the document conveying apparatus 100, the original fixed reading is carried out.

Modulating the laser light on the basis of the inputted video signal, the exposure controller 110 of the printer 300 may output this laser light, and this laser light is irradiated on a photosensitive drum 111 as an image bearing member as being scanned by a polygon mirror 110*a*. An electrostatic latent image in accordance with the scanned laser light is formed on the photosensitive drum 111. Here, as described later, the exposure controller 110 may output the laser light so that a correct image (an image that is not a mirror image) is formed when reading the original according to the document fixed reading method.

The electrostatic latent image formed on the photosensitive drum 111 is made into a visible image as a developer image by a developer to be supplied from a development portion 113. In addition, a sheet is fed from respective cassettes 114 and 115; a manual paper feed portion 125 or a sheet re-feeding path 124 at timing in synchronization with start of irradiation of the laser light; and this sheet is conveyed between the photosensitive drum 111 and a transfer portion 116. The developer image formed on the photosensitive drum 111 is transferred on the sheet that is fed by the transfer portion 116.

The sheet on which the developer image is transferred is fed to a fixing portion 117, and the fixing portion 117 may fix the developer image on the sheet by heat-pressing the sheet. The sheet passed through the fixing portion 117 is discharged from the printer 300 to the outside (a folding device 500) passing through a flapper 121 and a discharge roller pair 118.

Here, in the case of discharging the sheet with its image formed face downward (face down), the sheet passed through the fixing portion 117 is introduced into a reversal path 122 once by the switching operation of the flapper 121, and switching back the sheet after the rear end of the sheet passes through the flapper 121, the sheet is discharged from the printer 300 by the discharge roller pair 118. Hereinafter, this discharge state is called as a reversal discharge. This reversal discharge is carried out in the case of forming an image starting from a head page when forming an image which is read by the document conveying apparatus 100 or when forming an image which is outputted from a computer. The order of the discharged sheet becomes a correct page number.

In addition, when a hard sheet such as an OHP sheet is fed from the manual paper feed portion 125, and when forming an image on this sheet, the discharge roller pair 118 may discharge the sheet with the image formed face upward (face up) without introducing the sheet to the reversal path 122.

Further, in the case that the two-side recording for forming an image on the two sides of the sheet is set, the sheet is controlled in such a manner that the sheet is conveyed to the sheet re-feeding path 124 after introducing the sheet to the reversal path 122 due to the switching operation of the flapper 121, and then, the sheet introduced to the sheet re-feeding path 124 is fed again between the photosensitive drum 111 and the transfer portion 116 at the above-described timing.

The sheet discharged from the printer 300 will be sent to the folding device 500. This folding device 500 carries out the processing to fold down the sheet into a Z shape. For example, when the sheet is in size A3 or B4 and the folding down processing is designated, the folding device 500 may carry out the folding down processing; and in the other case, the sheet discharged from the printer 300 may be sent to the binding device 600, further to the finisher 700 passing through the folding device 500.

The binding device 600 may carry out the processing for folding down the sheet into half and closing it. The finisher 700 may carry out each processing such as sewing processing.

Figure 2:
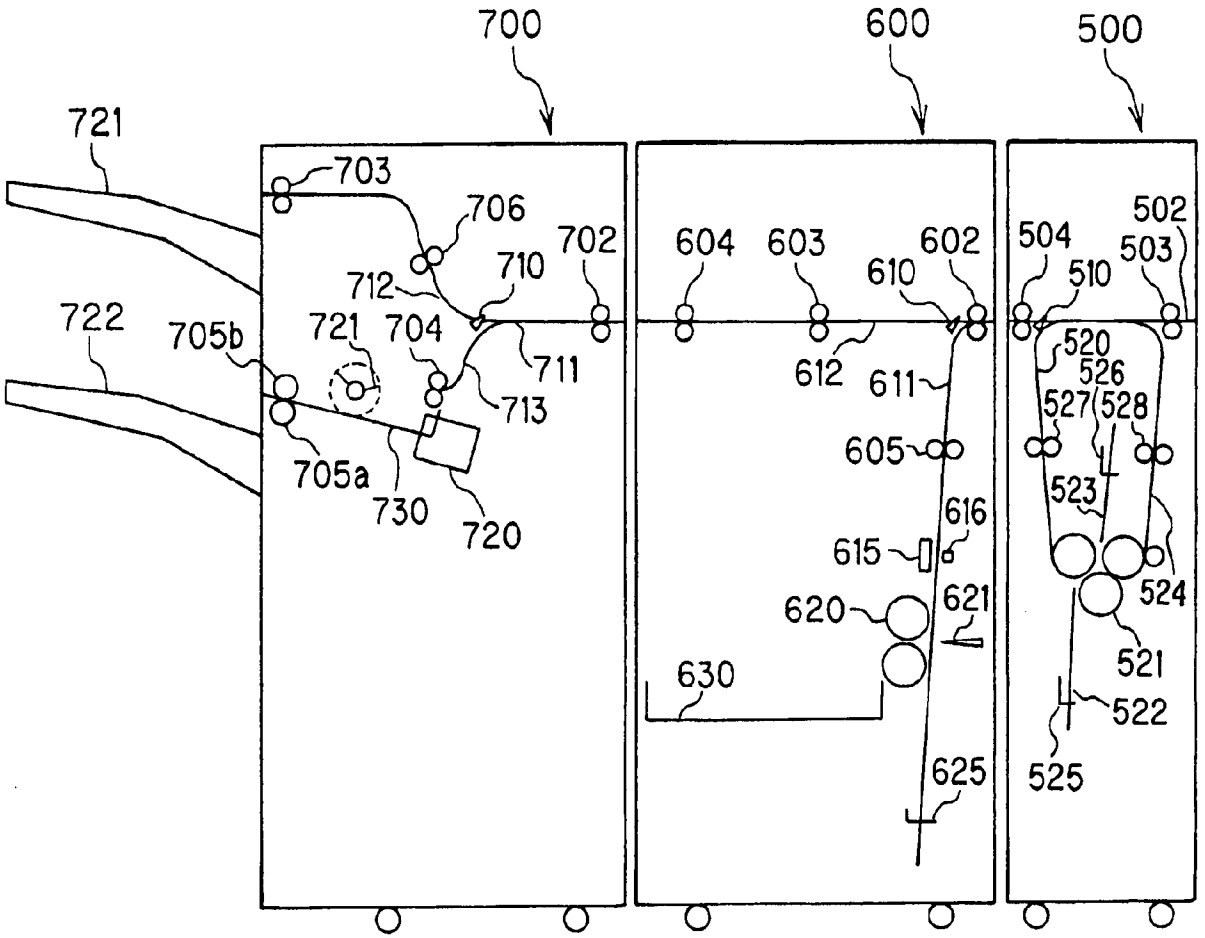
FIG. 2 is a schematic diagram showing a folding device, a binding device, and a finisher according to the embodiment of the present invention.

Next, the structures of the folding device 500, the binding device 600, and the finisher 700 will be explained with reference to FIG. 2. FIG. 2 illustrates the structures of the folding device 500, the binding device 600, and the finisher 700, which configure the image forming apparatus 1 shown in FIG. 1.

As shown in FIG. 2, the folding device 500 has a folding conveying horizontal path 502 for introducing the sheet discharged from the printer 300 and leading the sheet to the side of the binding device 600. On the folding conveying horizontal path 502, a conveyance roller pair 503 and a conveyance roller pair 504 are provided. In addition, at an outlet port (the side of the binding device 600) of the folding conveying horizontal path 502, a folding path selection flapper 510 is provided. This folding path selection flapper 510 will carry out the switching operation for leading the sheet on the folding conveying horizontal path 502 to the side of a folding path 520 or the side of the binding device 600.

Here, in the case of carrying out the folding processing, the folding path selection flapper 510 is turned on and the sheet is lead to the folding path 520. The sheet lead to the folding path 520 is further lead to a folding path 522 and is conveyed till its front end reaches a first folding stopper 522. After that, at the same time as the sheet is lead to a folding path 523 by a folding roller 521, the quarter part from the end is folded and the sheet is conveyed until the end reaches the second folding stopper 526. In addition, at the same time as the sheet is lead to a folding path 524 by the folding roller 521, the center part of the sheet is folded to be folded down into a Z shape. On the contrary, when the folding processing is not carried out, the folding path selection flapper 510 is turned off, and the sheet is directly sent to the binding device 600 from the printer 300 via the folding conveying horizontal path 502.

The binding device 600 has a binding horizontal path 612 for introducing the discharged sheet via the folding device 500 and leading the sheet to the side of the finisher 700. On the binding horizontal path 612, conveyance roller pairs 602, 603, and 604 are provided. In addition, at an inlet port (the side of the folding device 500) of the binding horizontal path 612, a binding path selection flapper 610 is provided. This binding path selection flapper 640 will carry out the switching operation for leading the sheet on the binding horizontal path 612 to the side of a binding path 611 or the side of the finisher 700.

Here, in the case of carrying out the binding processing, the binding path selection flapper 610 is turned on, and the sheet is lead to the binding path 611. The sheet lead to the binding path 611 will be conveyed till the front end of the sheet contacts a movable sheet positioning member 625 by conveyance roller pair 605. On the middle position of the binding path 611, two pairs of staplers 615 are provided, and this stapler 615 is configured so as to close the center of a sheet bundle in cooperation with an anvil 616 facing thereto.

At a downstream of the stapler 615, a pair of folding rollers 620 is provided. At the opposed position of the folding rollers 620, an ejecting member 621 is provided. By ejecting this ejecting member 621 toward the sheet bundle stored in the binding path 611, this sheet bundle is pushed out between the pair of folding rollers 620. After folded down by this pair of folding rollers 620, this sheet bundle is discharged to a binding discharge tray 630.

In addition, in the case of folding the sheet bundle which is sewn by the stapler 615, a sheet positioning member 625 declines for a predetermined distance so that the stapled position is made into the center of the pair of folding rollers 620 after the staple processing is terminated.

On the contrary, when no binding processing is carried out, the binding path selection flapper 610 is turned off, and the sheet is lead from the folding device 500 to the finisher 700 via the binding horizontal path 612.

The finisher 700 may carry out each sheet processing such as the processing for taking in the sheets discharged from the folding device 500 and the binding device 600 by rotation and binding the taken-in plural sheets into one bundle; the staple processing for sewing the rear ends of the bound sheet bundle by the stapler; the sort processing, and the non-sort processing.

As shown in FIG. 2, the finisher 700 has a pair of inlet rollers 702 for leading the sheet discharged from the printer 300 via the folding device 500 and the binding device 600 to the interior thereof. The sheet conveyed by the pair of inlet rollers 702 will be lead to a finisher path 711. At a downstream of the finisher path 711, a switching flapper 710 is arranged. The switching flapper 710 serves as a flapper for leading the sheet to a non-sort path 712 or a sort path 713.

In the case of carrying out the non-sort processing, the switching flapper 710 is turned on, and the sheet is lead to the non-sort path 712. Then, the sheet may be discharged on a sample tray 721 via a pair of conveyance roller 706 and a pair of non-sort discharge rollers 703 which are provided on the non-sort path 712.

On the contrary, in the case of carrying out the staple processing and the sort processing, the switching flapper 710 is turned off and the sheet is lead to a sort path 713. The sheets lead to the sort path 713 may be accumulated on a middle tray 730 via a pair of sort discharge rollers 704.

The sheets accumulated on the middle tray 730 in the shape of a bundle may be discharged on a stack tray 722 by a pair of discharge rollers 705 (705*a*, 705*b*) after the matching processing and the staple processing or the like are carried out according to needs. The staple processing for sewing the sheets accumulated on the middle tray 730 in the shape of a bundle is carried out by using a stapler 720. A stack tray 722 is configured so as to be capable of self-propelling vertically.

Next, a conveyance roller (a sheet conveyance roller) having an IC tag embedded therein according to the present embodiment will be described on the basis of the embodiment with reference to the drawings.

The conveyance roller having the IC tag embedded therein according to the present embodiment can be preferably applied to the discharge roller pair 118 which are incorporated in the printer 300; the conveyance roller pair 503 and 504 which are incorporated in the folding device 500; the conveyance roller pairs 602, 603, and 604 which are incorporated in the binding device 600; and the pair of inlet rollers 702, the pair of conveyance roller 706, and the pairs of the discharge rollers 703, 704, and 705, which are incorporated in the finisher 700, as described above. In the following respective embodiment shown below, it is determined that the same reference numerals are given to the same component as the above-described embodiment.

Embodiment 1

Figure 3:
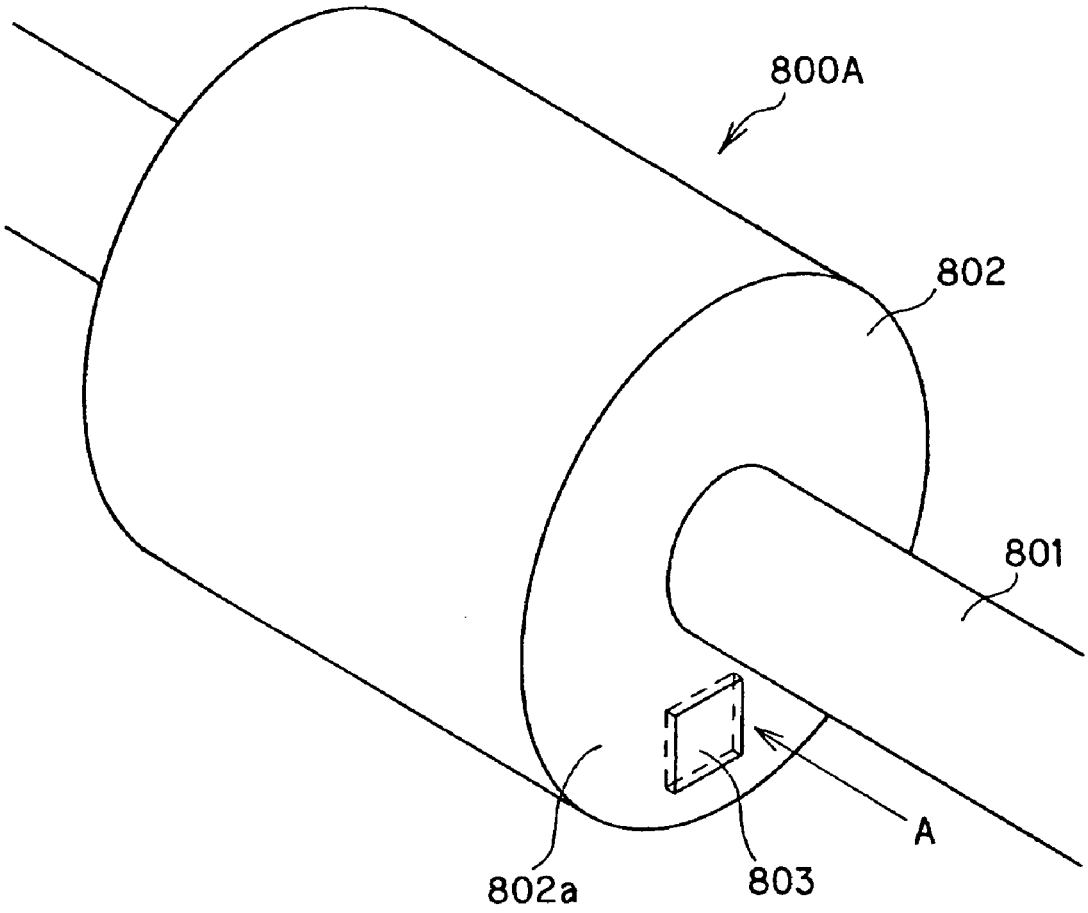
FIG. 3 is a schematic diagram of a conveyance roller according to a first embodiment of the present invention.

FIG. 3 is an enlarged view of a roller portion of a conveyance roller 800A according to a first embodiment of the present invention.

The conveyance roller 800A is provided with a roller axis 801 and a rubber roller 802 incorporated in the roller axis 801 as a rotational member. A conveyance roller 800A may convey a sheet as a material to be conveyed which abuts against the outer peripheral part of the rubber roller 802 upon rotation.

Then, on a thrust edge face 802*a* of the rubber roller 802 (namely, the edge face of the rubber roller 802 in the axial direction of the roller axis 801), an IC tag 803 is embedded. In other words, the IC tag 803 is provided on the thrust edge face 802*a* which is an area having no influence on a conveying function of the outer peripheral part of the rubber roller 802. The IC tag 803 is molded integrated with the rubber roller 802 and the IC tag 803 is solidly fixed thereto without using an adhesive agent or the like.

Upon discard of the conveyance roller 800A, it is possible to separate the components made of different materials by detaching the rubber roller 802 from the roller axis 801 and detaching the IC tag 803 from the rubber roller 802. In order to separate the IC tag 803 from the rubber roller 802, for example, the front end of a minus driver is inserted from an arrow A direction in the drawing into the IC tag 803.

By embedding the IC tag 803 on the thrust edge face 802*a* of the rubber roller 802 and integrally molding it thereon, the IC tag 803 can be attached to the rubber roller 802 without solid adhesion, and they can be easily separated, for example, by the minus driver or the like.

Further, in FIG. 3, the IC tag 803 is disposed with a part thereof exposed from the thrust edge face 802*a*, however, the IC tag 803 may be completely embedded in the rubber roller 802. In this case, an identification mark is given to the part of the rubber roller 802 in which the IC tag 803 may be embedded, and as described later, winding a sheet-like member around the IC tag 803, this sheet-like member may be exposed from the thrust edge face 802*a*.

Embodiment 2

Figure 4:
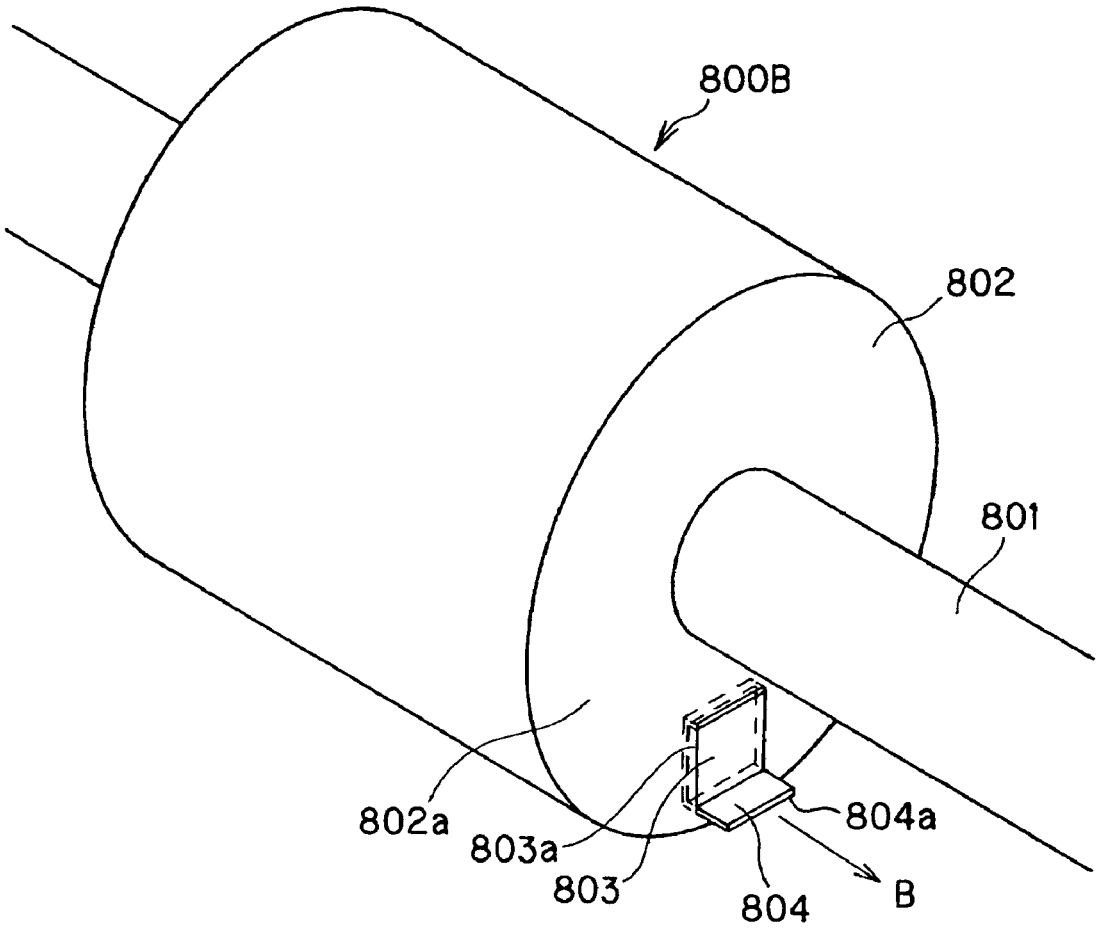
FIG. 4 is a schematic diagram of a conveyance roller according to a second embodiment of the present invention.

FIG. 4 is an enlarged view of a roller portion of a conveyance roller 800B according to a second embodiment of the present invention.

The conveyance roller 800B is provided with a roller axis 801 and a rubber roller 802 which is incorporated in the roller axis 801.

Then, on a thrust edge face 802*a* of the rubber roller 802, an IC tag 803 is embedded. The IC tag 803 is configured with a sheet-like member 804 such as a PET (polyethylene terephthalate) film wounded around a main body of the IC tag 803*a*. The IC tag 803 on which the sheet-like member 804 is wounded is molded integrated with the rubber roller 802 and the IC tag 803 is solidly fixed thereto without using an adhesive agent or the like. In addition, one end of the sheet-like member 804 is provided being projected from the thrust edge face 802*a* of the rubber roller 802.

Upon discard of the conveyance roller 800B, by grasping a projection part 804*a* of the sheet-like member 804 which is projected from the thrust edge face 802*a* and pulling the sheet-like member 804 in a direction B in the drawing, it is possible to separate the IC tag 803 from the rubber roller 802 together with the sheet-like member 804. According to the present embodiment, it is possible to separate the IC tag 803 from the rubber roller 802 more easily.

Embodiment 3

Figure 5:
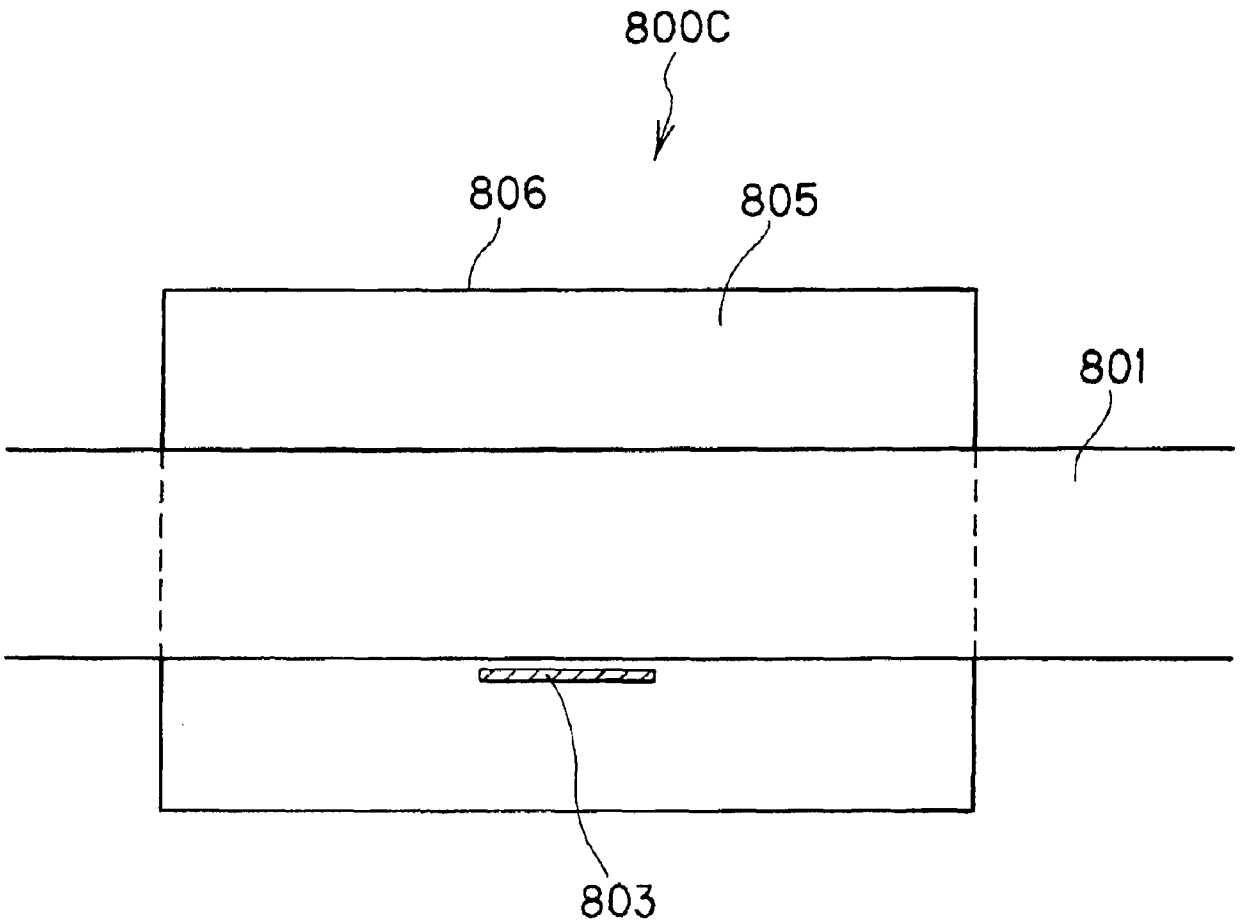
FIG. 5 is a schematic diagram of a conveyance roller according to a third embodiment of the present invention.

FIG. 5 is an enlarged view of a roller portion of a conveyance roller 800C according to a third embodiment of the present invention.

The conveyance roller 800C is provided with a roller axis 801 and a sponge roller 805 which is incorporated in the roller axis 801 as a rotational member.

According to the present embodiment, the sponge roller 805 is formed by a soft sponge-like member such as a foaming material.

Then, according to the present embodiment, since the sponge roller 805 is a roller formed by a soft material such as a sponge, an IC tag 803 is embedded in a location which is near the roller axis 801 and is separate from a roller surface layer (the outer peripheral part) 806 of the sponge roller 805 and the sponge roller 805 is integrally molded so as to prevent a degree of hardness of the sponge roller 805 from being changed and the roller surface layer 806 from being influenced.

Upon discard of the conveyance roller 800C, separating the sponge roller 805 from the roller axis 801, the IC tag 803 is removed from the inner diameter part of the sponge roller 805.

Accordingly, without giving influence on the roller surface layer 806, the IC tag 803 can be attached on the sponge roller 805 and further, the IC tag 803 can be easily separated from the sponge roller 805.

Embodiment 4

Figure 6:
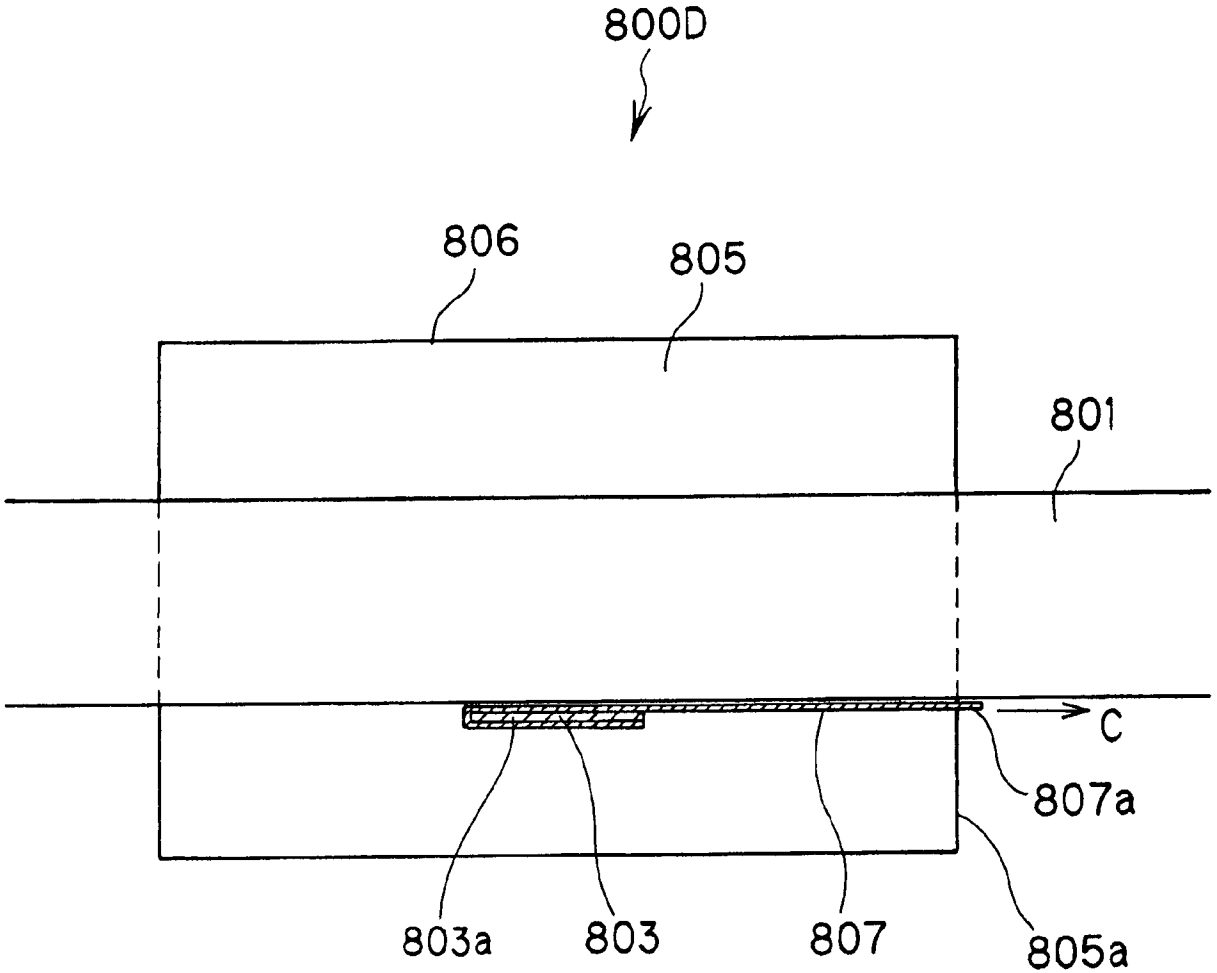
FIG. 6 is a schematic diagram of a conveyance roller according to a fourth embodiment of the present invention.

FIG. 6 is an enlarged view of a roller portion of a conveyance roller 800D according to a fourth embodiment of the present invention.

The conveyance roller 800D is provided with a roller axis 801 and a sponge roller 805 which is incorporated in the roller axis 801.

Then, an IC tag 803 is embedded in a location which is near the roller axis 801 and is separate from a roller surface layer 806 of the sponge roller 805 and the sponge roller 805 is integrally molded so as to prevent a degree of hardness of the sponge roller 805 from being changed and the roller surface layer 806 from being influenced.

Further, the IC tag 803 of the present embodiment is configured in such a manner that a sheet-like member 807 such as a PET film is wounded around a main body of the IC tag 803*a*, and one end of the sheet-like member 807 is provided being projected from the roller edge face 805*a*.

Upon discard of the conveyance roller 800D, by grasping a projection part 807*a* of the sheet-like member 807 which is projected from the roller edge face 805*a* and pulling the sheet-like member 807 in a direction C in the drawing, it is possible to separate the IC tag 803 from the sponge roller 805 together with the sheet-like member 807.

Accordingly, without giving influence on the roller surface layer 806, the IC tag 803 can be attached on the sponge roller 805 and further, the IC tag 803 can be more easily separated from the sponge roller 805.

Embodiment 5

Figure 7:
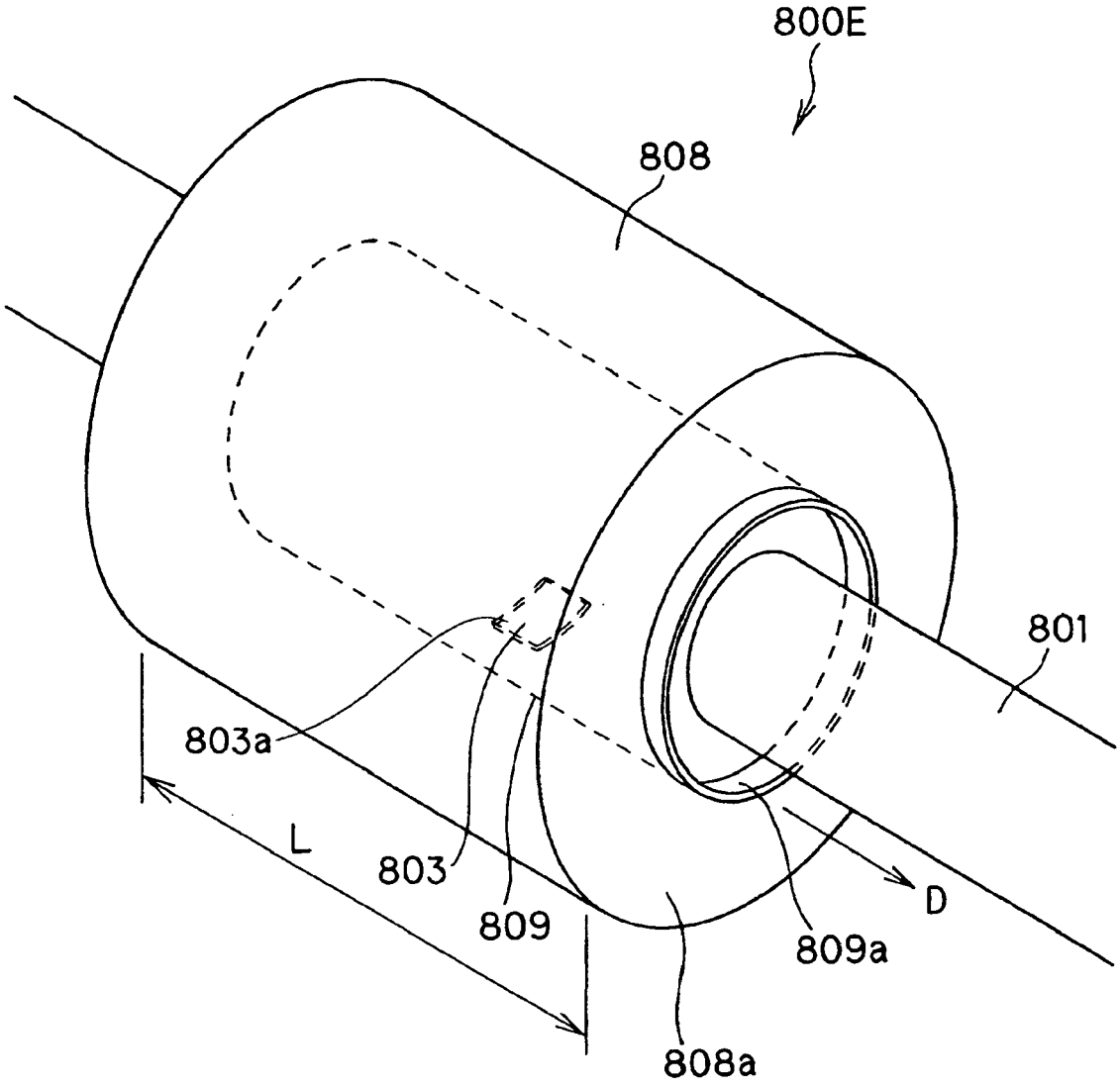
FIG. 7 is a schematic diagram of a conveyance roller according to a fifth embodiment of the present invention.

FIG. 7 is an enlarged view of a roller portion of a conveyance roller 800E according to a fifth embodiment of the present invention.

The conveyance roller 800E is provided with a roller axis 801 and a sponge roller 808 which is incorporated in the roller axis 801 as a rotational member, and the sponge roller 808 is formed by a soft sponge-like member such as a foaming material.

Then, an IC tag 803 is embedded in the sponge roller 808 and the sponge roller 805 is integrally molded so as to prevent a degree of hardness of the sponge roller 808 from being changed and the roller surface layer of the sponge roller 808 from being influenced.

The IC tag 803 according to the present embodiment is configured by attaching a sheet-like member 809 shaped in a ring having the same degree of hardness as that of the main body of the IC tag 803*a* to a main body of the IC tag 803*a*, and the sheet-like member 809 to which the main body of the IC tag 803*a* is attached is embedded in the sponge roller 808.

The sheet-like member 809 shaped in a ring has a length at least covering from one edge face of the sponge roller 808 till the other edge face (namely, a length L in the drawing).

Thereby, even in the case that particular attention should be given to the roller surface layer, it is possible to prevent the influence of the IC tag which is a foreign body on the inside on the whole area covered by the sponge roller length L.

In the case of separating the sheet-like member 809 shaped in a ring, by grasping the end of the sheet-like member 809 from a roller thrust edge face 808*a* and pulling it in a direction D in the drawing, it is possible to easily separate the sheet-like member 809 shaped in a ring from the sponge roller 808, so that the IC tag 803 can be easily separated from the sponge roller 808.

Further, the sheet-like member 809 may be provided being projected from the roller thrust edge face 808*a*. This makes it possible to separate the sheet-like member 809 shaped in a ring from the sponge roller 808 by grasping a projection part 809*a* which is projecting and pulling it in a direction D in the drawing, so that the IC tag 803 can be easily separated from the sponge roller 808.

Embodiment 6

Figure 8:
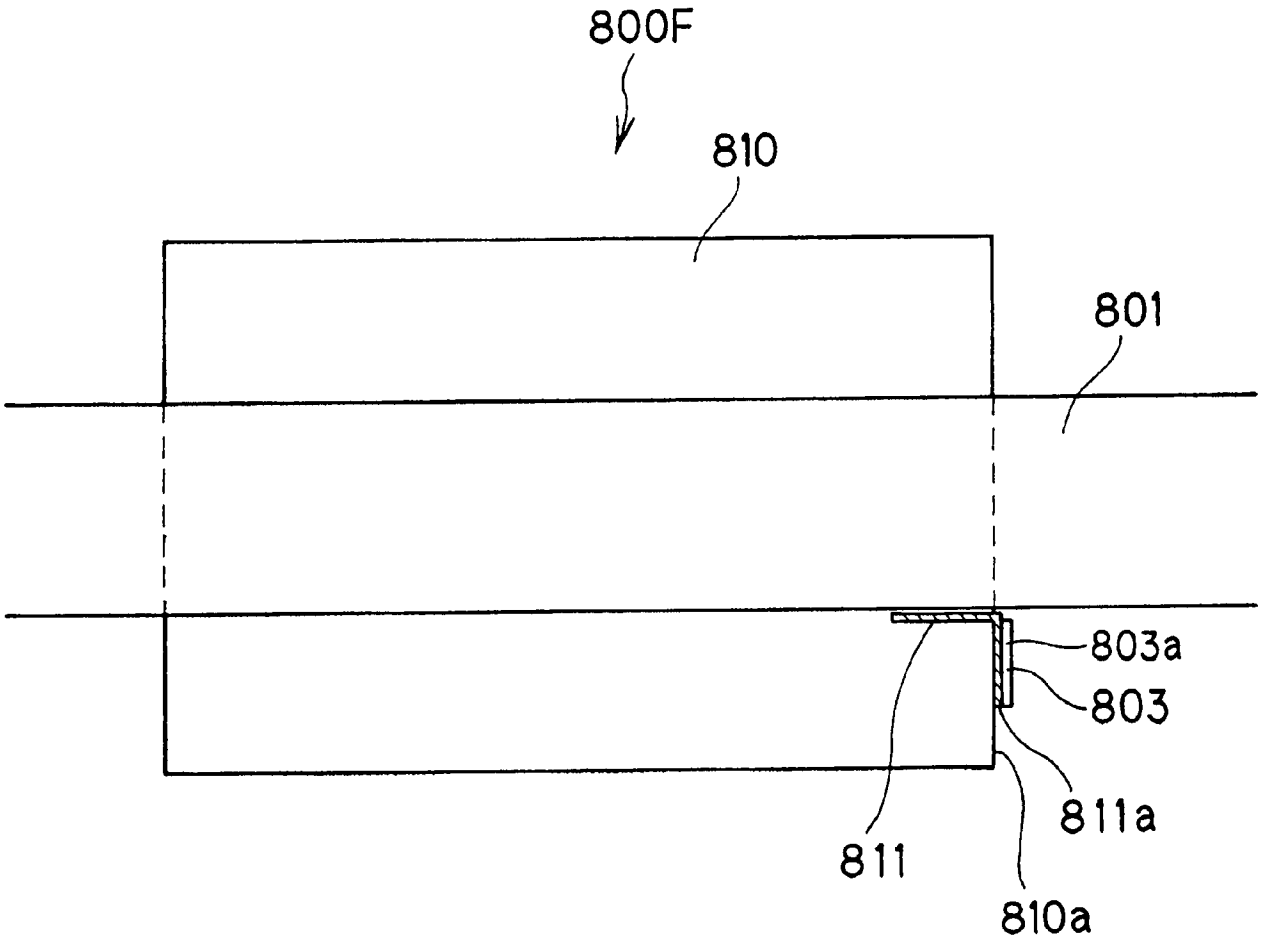
FIG. 8 is a schematic diagram of a conveyance roller according to a sixth embodiment of the present invention.

FIG. 8 is an enlarged view of a roller portion of a conveyance roller 800F according to a sixth embodiment of the present invention.

The conveyance roller 800F is provided with a roller axis 801 and a roller 810 which is incorporated in the roller axis 801 as a rotational member.

An IC tag 803 is configured by attaching a sheet-like member 811 such as a PET film to a main body of the IC tag 803*a*.

According to the present embodiment, by embedding the sheet-like member 811 inside of the roller 810, the main body of the IC tag 803*a* is attached to a projection part 811*a* projecting from a thrust edge face 810*a* of the roller 810 in the sheet-like member 811.

Since one end of the sheet-like member 811 is embedded in the roller 810 and the main body of the IC tag 803*a* is attached to a free part (the outside of the roller 810) of the other end, the IC tag 803 has no influence on the roller 810.

UPON DISCARD OF THE CONVEYANCE ROLLER 800F, THE IC TAG 8030F THE SHEET-LIKE MEMBER 811 PULLS THE ATTACHED PART, SO THAT THE IC TAG 803 CAN BE SEPARATED FROM THE ROLLER 810.

Accordingly, without giving influence on the roller 810, the IC tag 803 can be attached and further, the IC tag 803 can be easily separated from the roller 810.

The conveyance roller having the IC tag embedded therein according to the present embodiment has been described as above with reference to the first to sixth embodiments. Since the above-described roller pair to be applied to the image forming apparatus 1 according to the present embodiment has a rather high degree of hardness, even in the case that the IC tag 803 is embedded inside of the roller portion, the IC tag 803 has less influence on the roller surface layer. In such a case, the conveyance roller 800B described in the second embodiment may be applied.

By appropriately applying the optimum system from among the embedding systems described in the first to sixth embodiments in consideration of the influence that is given on the roller surface layer by the IC tag 803 in this way, the IC tag can be disposed to the conveyance roller without blocking the function of the conveyance roller, and upon discard of the conveyance roller, the IC tag can be easily separated from the conveyance roller.

Figure 12:
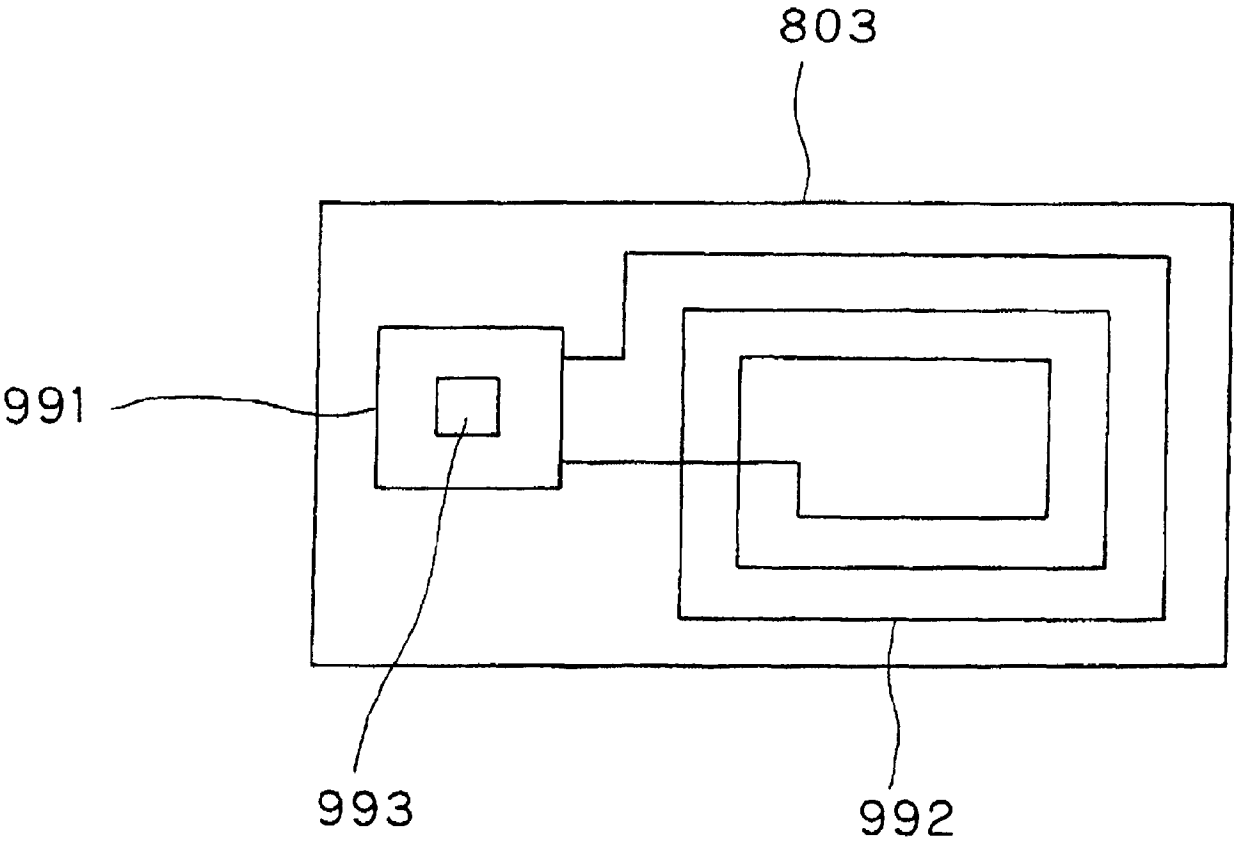
FIG. 12 is a view explaining the structure of the IC tag according to the present invention.

As shown in FIG. 12, the above-described IC tag 803 is configured by an IC chip 991 and an antenna 992 or the like for wireless communication. The IC chip 991 incorporates a memory portion 993 therein. The memory portion 993 memorizes (stores) information of the conveyance roller. The antenna 992 serves to make communication for reading the information stored in the IC chip 991 in a no-contact system and transmitting the information to be stored in the IC chip 991.

A communication method between the IC tag 803 and a control apparatus 812 as a writing means of writing the information in the IC tag 803 will be described below.

Figure 9:
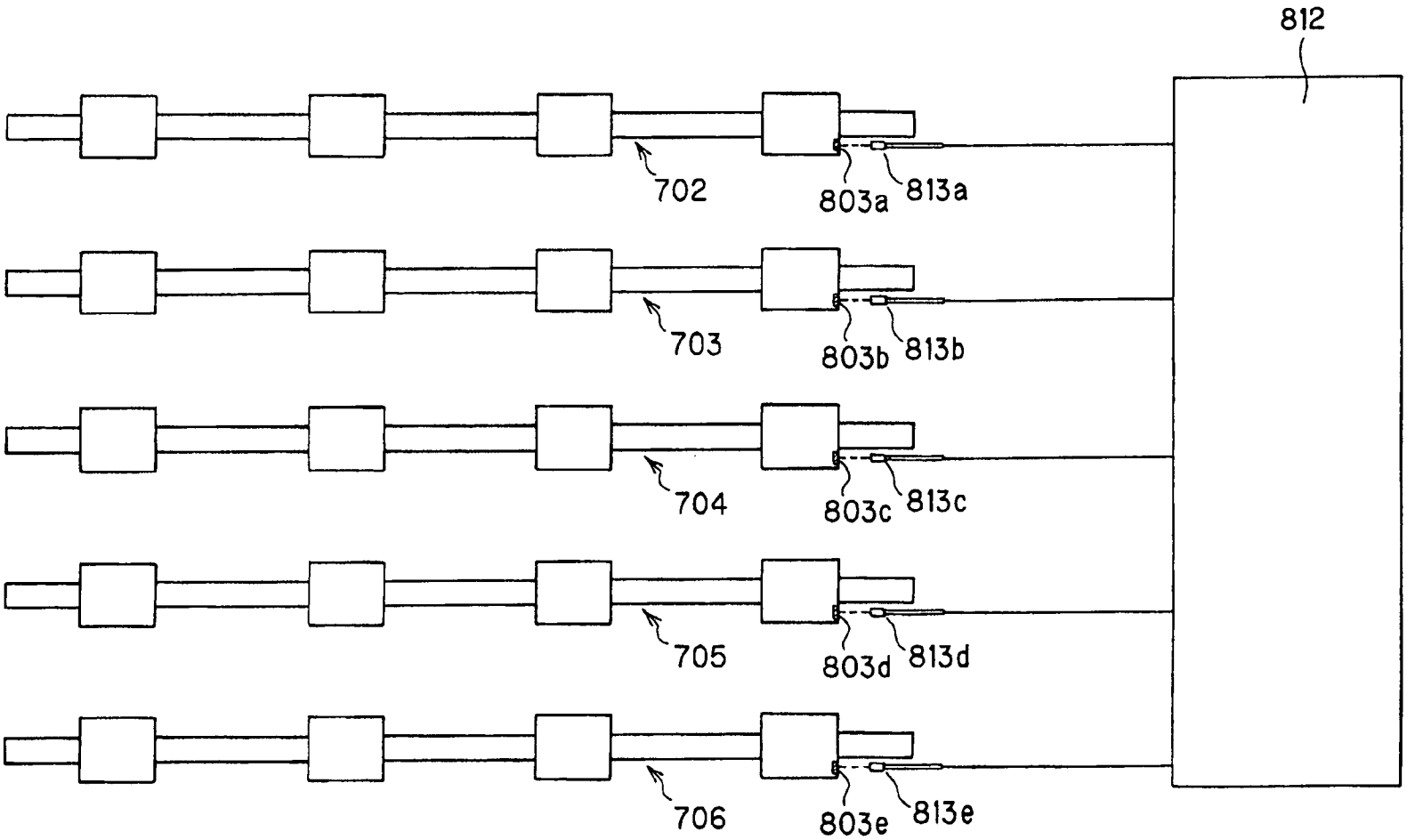
FIG. 9 is a view for explaining a communication method between an IC tag embedded in each roller pair and a control apparatus for writing the information in the IC tag according to the present invention.
Figure 10:
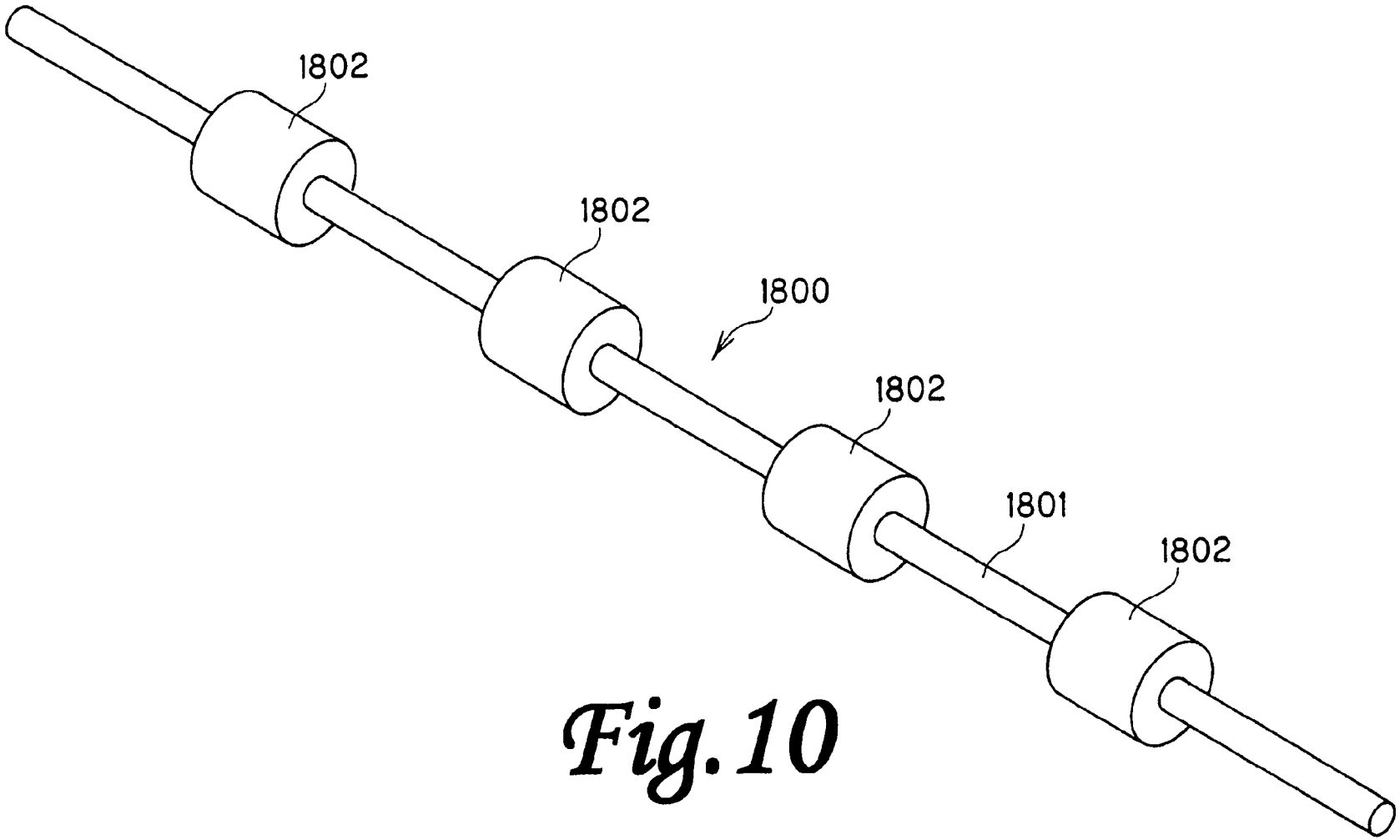
FIG. 10 is a schematic diagram showing a conventional example of the conveyance roller.
Figure 11:
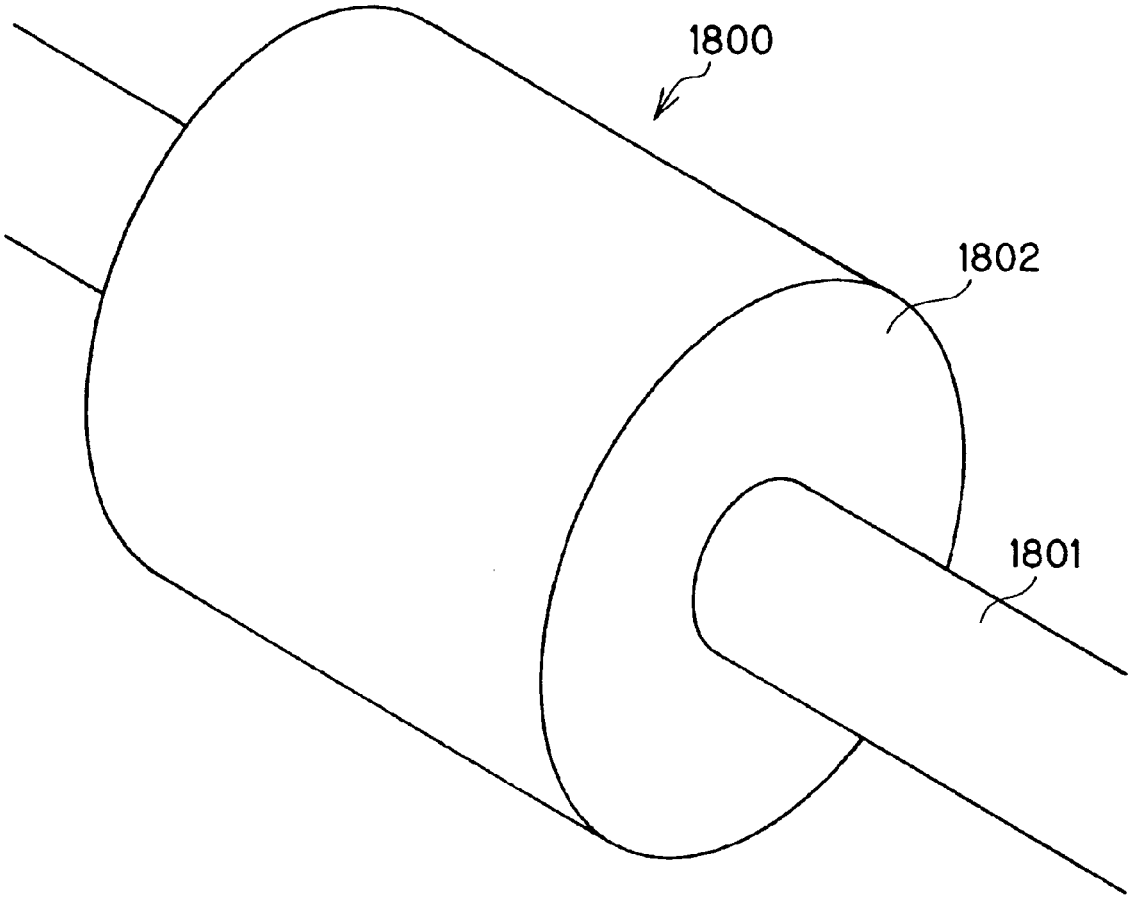
FIG. 11 is a schematic diagram showing a conventional example of the conveyance roller.

FIG. 9 is a view for explaining a communication method between the IC tags 803 embedded in the pair of inlet rollers 702, the pair of conveyance roller 706, and the pairs of the discharge rollers 703, 704, and 705 and the control apparatus 812 in the finisher 700.

The control apparatus 812 located inside of the finisher 700 may write the information regarding the state of use of the conveyance roller that is detected by the detecting means in the IC tags 803 through a communication antenna 813 (813*a*, 813*b*, 813*c*, 813*d*, and 813*e*). The information regarding the state of use of the conveyance roller is the information such as the number of rotation of each conveyance roller and the number of sheets conveyed by the conveyance roller.

Due to such a structure, upon recover and unbuilding of the finisher 700, taking out the pair of inlet rollers 702, the pair of conveyance roller 706, and the pairs of the discharge rollers 703, 704, and 705 and selecting the roller with reference to the information written in each IC tag, the roller can be reused or can be discarded or can be selected.

As same as the finisher 700 shown in FIG. 9, the printer 300, the folding device 500, and the binding device 600 are configured so that each device has a control apparatus and a communication antenna so as to make the informational communication with the IC tag of the conveyance roller that is incorporated in each device. Thereby, the information written in each IC tag can be used as the selection data upon reuse of the conveyance roller.

This application claims priority from

Japanese Patent Application No. 2005-161140 filed Jun. 1, 2005, which is hereby incorporated by reference, herein.

What is claimed is:

1. A sheet conveyance roller, having:

a rotational member that rotates to convey a sheet, wherein the rotational member has an outer peripheral part abutting against a sheet conveyed and a thrust edge face not abutting against a sheet conveyed; and an IC tag having a storage function and a wireless communication function, wherein in a state in which a part of the IC tag is embedded in the rotational member, an other part of the IC tag is protruded from the thrust edge face of the rotational member in a thrust direction, and wherein by pulling out the other part of the IC tag that is protruded from the thrust edge face of the rotational member in the thrust direction, the IC tag can be separated from the rotational member.

2. The sheet conveyance roller according to claim 1, wherein the IC tag comprises a main body of the IC tag and a sheet-like member that is attached to the main body of the IC tag; and the part of the sheet-like member is protruded from the thrust edge face of the rotational member.

3. The sheet conveyance roller according to claim 2, wherein the main body of the IC tag is embedded in the thrust edge face of the rotational member adjacent an axis of the rotational member.

4. The sheet conveyance roller according to claim 1, wherein the IC tag is provided at the outer periphery of an axis of the rotational member shaped in a ring.

5. The sheet conveyance roller according to claim 2, wherein the sheet-like member has the same degree of hardness as that of the main body of the IC tag.

6. The sheet conveyance roller according to claim 1, wherein the IC tag is embedded in the area near an axis of the rotational member.

7. The sheet conveyance roller according to claim 1, wherein the IC tag comprises the main body of the IC tag and the sheet-like member that is attached to the main body of the IC tag; and the part of the main body of the IC tag is exposed from the thrust edge face of the rotational member.

8. The sheet conveyance roller according to claim 1, wherein the IC tag comprises the main body of the IC tag and the sheet-like member that is attached to the main body of the IC tag; and the part of the sheet-like member is embedded in the rotational member, and the main body of the IC tag is provided at the part that is exposed from the thrust edge face of the rotational member in this sheet-like member.

9. The sheet conveyance roller according to claim 1, wherein the IC tag comprises the main body of the IC tag and the sheet-like member that is attached to the main body of the IC tag; and the part of the sheet-like member is exposed from the rotational member with the main body of the IC tag embedded in the rotational member.

10. The sheet conveyance roller according to claim 1, wherein the rotational member is formed by a foaming material.

11. The sheet conveyance roller according to claim 1, wherein the rotational member is a rubber roller; and the IC tag and the rubber roller are integrally molded so that at least part of the IC tag is embedded in the rubber roller.

12. A sheet processing apparatus, comprising:

a sheet conveyance roller according to claim 1; and a writing means of writing the information regarding the state of use of the sheet conveyance roller in the IC tag.

13. The sheet processing apparatus according to claim 12, wherein the information regarding the state of use of the sheet conveyance roller is the number of sheets that are conveyed by the sheet conveyance roller.

14. A sheet conveyance roller, having:

a rotational member that rotates to convey a sheet, wherein the rotational member has an outer peripheral part abutting against a sheet conveyed and a thrust edge face not abutting against a sheet conveyed; and a unit, having an IC chip, that can wireless communicate and store information, wherein in a state in which a part of the unit is embedded in the rotational member, an other part of the unit is protruded from the thrust edge face of the rotational member in a thrust direction, wherein by pulling out the other part of the unit that is protruded from the thrust edge face of the rotational member in the thrust direction, the unit can be separated from the rotational member.

15. The sheet conveyance roller according to claim 14, wherein the unit stores information regarding the state of use of the sheet conveyance roller.

* * * * *